US005553406A

United States Patent [19]

Cerny

[11] Patent Number: 5,553,406

[45] Date of Patent: Sep. 10, 1996

[54] SMALL LIGHTWEIGHT SNOW FLINGER

[76] Inventor: Dell L. Cerny, 602 N. Carroll St., P.O. Box 306, Arnold, Nebr. 69120

[21] Appl. No.: 492,458

[22] Filed: Jun. 20, 1995

[51] Int. Cl.[6] ..... E01H 5/00

[52] U.S. Cl. ..... 37/259; 37/244

[58] Field of Search ..... 15/4, 236.02; 37/233, 37/234, 243, 244, 246, 259, 285, 260; 56/10.5, 11.3, 16.9; 180/19.3

[56] References Cited

U.S. PATENT DOCUMENTS

| | | | |
|---|---|---|---|
| 2,743,538 | 5/1956 | Linzy | 37/259 |
| 4,150,501 | 4/1979 | Hayashi | 37/259 X |
| 4,255,880 | 3/1981 | McMickle et al. | 37/259 |
| 4,378,644 | 4/1983 | Tuggle et al. | 37/244 |
| 4,679,338 | 7/1987 | Middleton | 37/244 |
| 4,680,881 | 7/1987 | Cloutier | 37/244 X |
| 5,161,318 | 11/1992 | Bergman et al. | 37/244 X |

FOREIGN PATENT DOCUMENTS

| | | | |
|---|---|---|---|
| 734662 | 5/1966 | Canada | 37/246 |

*Primary Examiner*—Terry Lee Melius
*Assistant Examiner*—Robert Pezzuto

[57] ABSTRACT

A small lightweight snow flinger comprising a central post adapted to be held by a user. A motor is mounted on the upper end of the post. Motion imparting mechanisms extend from the motor to a lower end of the post. A box is secured with respect to the lower end of the post. The box has a central vertical aperture therethrough. A plurality of blades are rotatable about a horizontal axis coextensive with the power mechanisms at the lower end of the tube to rotate the blades within the aperture and move particulate material such as snow entering the space between the rotating blades and to direct it upwardly through an aperture having a vertical axis in the box.

1 Claim, 4 Drawing Sheets

SMALL LIGHTWEIGHT SNOW FLINGER

BACKGROUND OF THE INVENTION

1. Field of the Invention

The present invention relates to a small lightweight snow flinger and more particularly pertains to remove settled snow from a side walk, drive way or like surface with a small light weight device.

2. Description of the Prior Art

The use of snow removal devices of various designs and configurations is known in the prior art. More specifically, snow removal devices of various designs and configurations heretofore devised and utilized for the purpose of removing snow by various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,571,838 to Stasechke discloses a snow removal implement.

U.S. Pat. No. 4,809,386 to Re discloses a combined manual implement for window snow removal, ice scraping, washing and drying, for vehicles in general.

U.S. Pat. No. 4,070,771 to Yakiwchuk discloses a portable snow blower.

U.S. Pat. No. 4,104,812 to Stribiak, Jr., discloses a snow blower for powered lawn mowers.

U.S. Pat. No. 3,643,356 to Gohl discloses a hand-operated snow removing tool.

Lastly, U.S. Pat. No. 5,163,276 to Mohrman discloses multi-purpose attachments for power lawn mower blades.

In this respect, the small lightweight snow flinger according to the present invention substantially departs from the conventional concepts and designs of the prior art, and in so doing provides an apparatus primarily developed for the purpose of remove settled snow from a side walk, drive way or like surface with a small light weight device.

Therefore, it can be appreciated that there exists a continuing need for new and improved small lightweight snow flinger which can be used for remove settled snow from a side walk, drive way or like surface with a small light weight device. In this regard, the present invention substantially fulfills this need.

SUMMARY OF THE INVENTION

In view of the foregoing disadvantages inherent in the known types of snow removal devices of various designs and configurations now present in the prior art, the present invention provides an improved small lightweight snow flinger. As such, the general purpose of the present invention, which will be described subsequently in greater detail, is to provide a new and improved small lightweight snow flinger apparatus and method which has all the advantages of the prior art and none of the disadvantages.

To attain this, the present invention essentially comprises a new and improved small lightweight snow flinger, comprising, in combination, a central post with an upper end, a lower end and an intermediate extent therebetween adapted to be held by a user. The post has a bend of about 30 degrees adjacent to its lower end. A motor is fixedly mounted on the upper end of the post for providing power. Motion imparting mechanisms extend from the motor to the lower end of the post. A box is secured with respect to the lower end of the post. The box has a central aperture therethrough with a horizontal axis. A plurality of blades are rotatable about a horizontal axis coextensive with the axis of the aperture of the box with power mechanisms at the lower end of the tube to rotate the veins within the aperture and move particulate material such as snow entering the aperture between the rotating blades and to direct it upwardly with an arcuate tube at an upper extent of the box for passage of the particulate material therethrough. A pair of wheels are mounted adjacent to the lower extent of the box to facilitate movement thereof. A releasable clamp couples the lower extent of the post with a central extent of the box.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved small lightweight snow flinger which has all the advantages of the prior art snow removal devices of various designs and configurations and none of the disadvantages.

It is another object of the present invention to provide a new and improved small lightweight snow flinger which may be easily and efficiently manufactured and marketed.

It is a further object of the present invention to provide a new and improved small lightweight snow flinger which is of a durable and reliable construction.

An even further object of the present invention is to provide a new and improved small lightweight snow flinger which is susceptible of a low cost of manufacture with regard to both materials and labor, and which accordingly is then susceptible of low prices of sale to the consuming public, thereby making such snow removal devices of various designs and configurations economically available to the buying public.

Still yet another object of the present invention is to provide a new and improved small lightweight snow flinger which provides in the apparatuses and methods of the prior art some of the advantages thereof, while simultaneously overcoming some of the disadvantages normally associated therewith.

Still another object of the present invention is to remove settled snow from a side walk, drive way or like surface with a small light weight device.

Lastly, it is an object of the present invention to provide a new and improved small lightweight snow flinger comprising a central post adapted to be held by a user. A motor is mounted on the upper end of the post. Motion imparting mechanisms extend from the motor to a lower end of the post. A box is secured with respect to the lower end of the post. The box has a central vertical aperture therethrough. A plurality of blades are rotatable about a horizontal axis coextensive with the power mechanisms at the lower end of the tube to rotate the blades within the aperture and move particulate material such as snow entering the space between the rotating blades and to direct it upwardly through an aperture having a vertical axis in the box.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
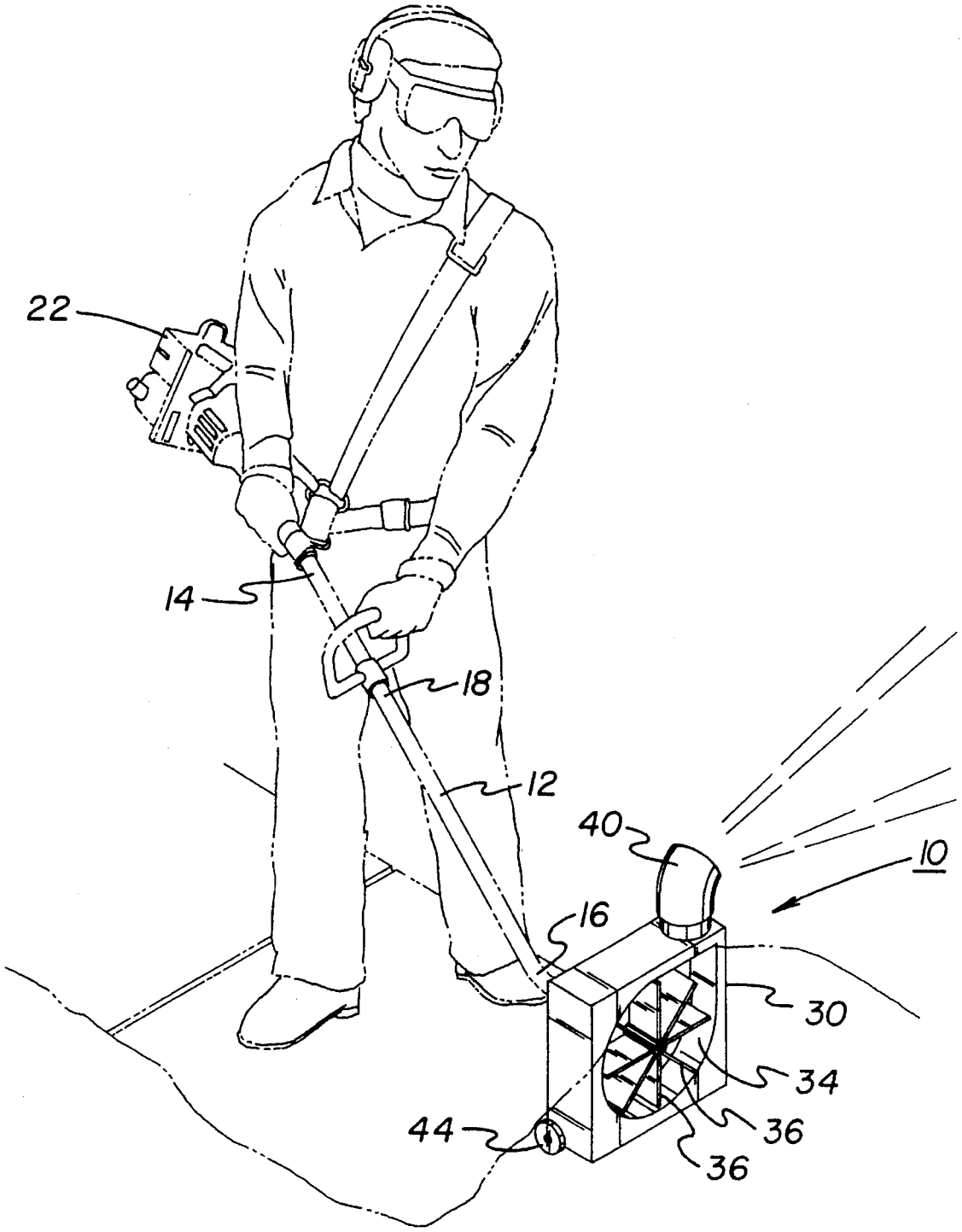
FIG. 1 is a perspective illustration of the preferred embodiment of the small lightweight snow flinger constructed in accordance with the principles of the present invention.
Figure 3:
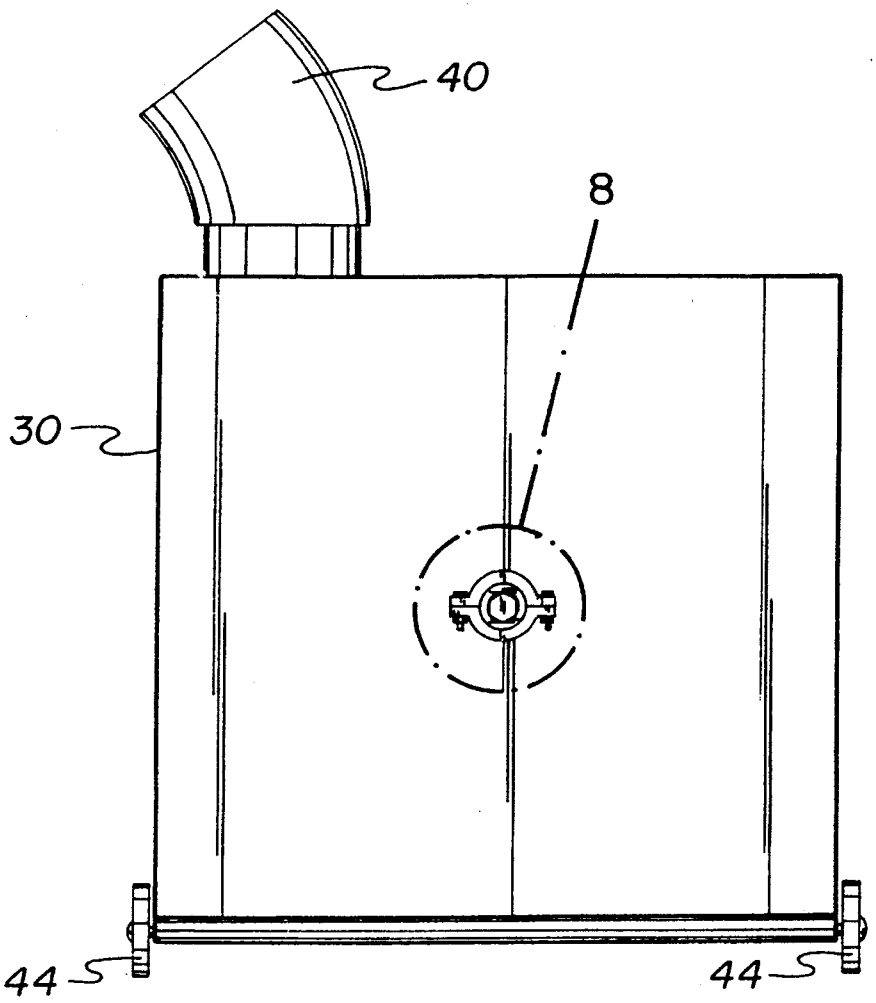
FIG. 3 is a rear elevational view of the apparatus shown in FIG. 2.
Figure 2:
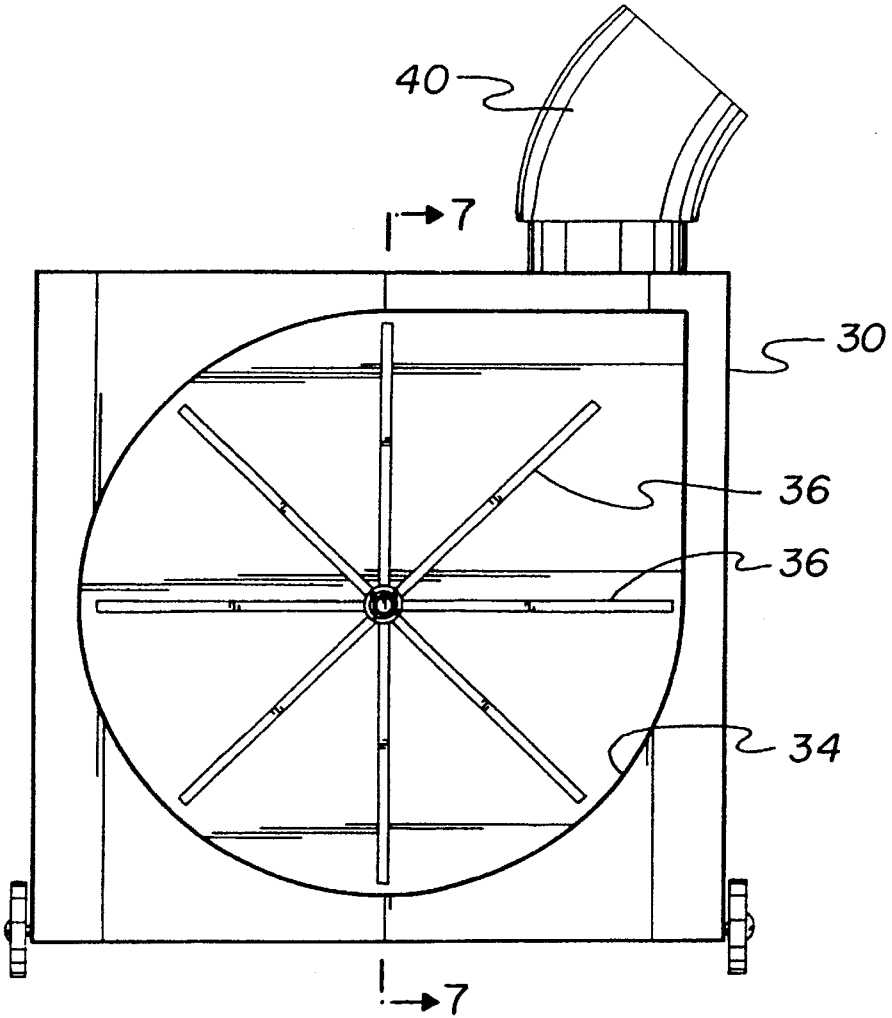
FIG. 2 is a front elevational view of the lower portion of the apparatus shown in FIG. 1.
Figure 6:
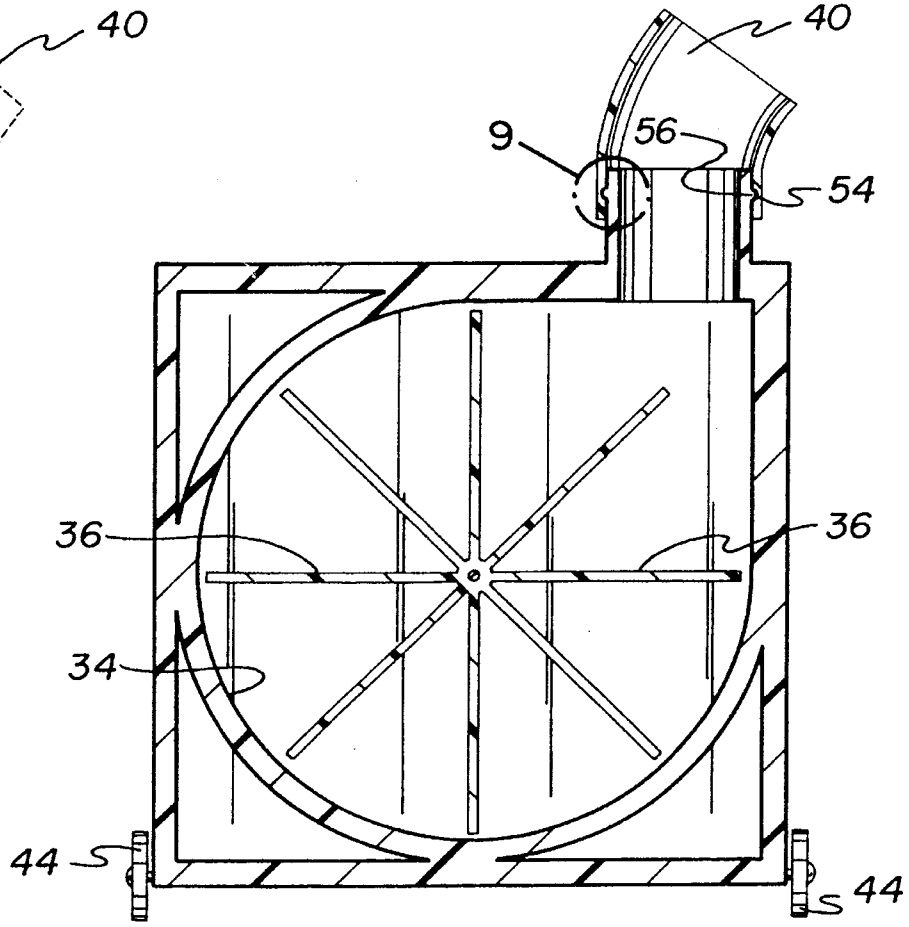
FIGS. 6 and 7 are cross sectional views taken alone line 6—6 of FIG. 4 and line 7—7 of FIG. 2, respectfully.
Figure 5:
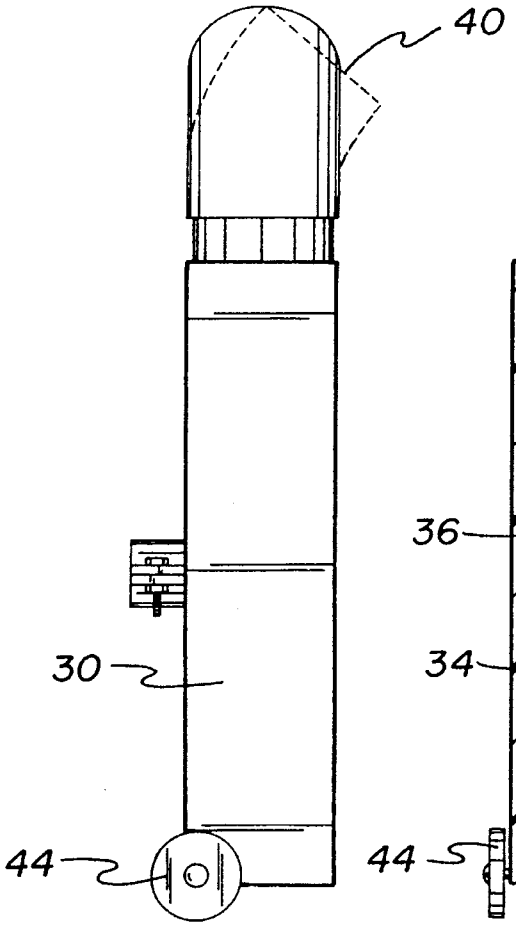
FIG. 5 is a side elevational view of the apparatus shown in the prior Figures.
Figure 4:
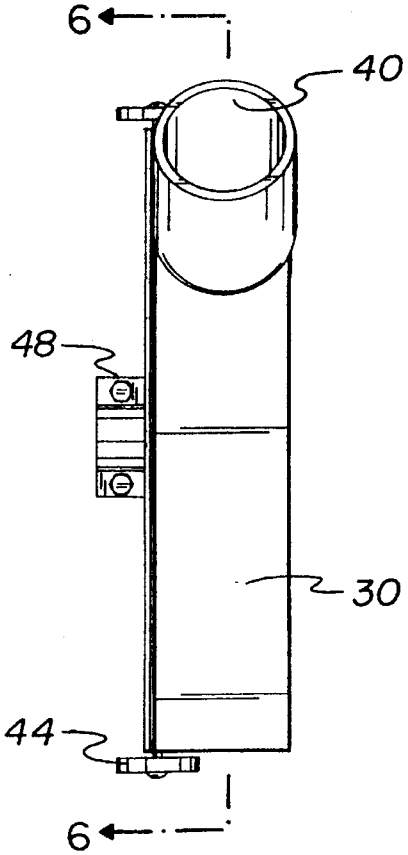
FIG. 4 is a top elevational view of the apparatus shown in the prior Figures.
Figure 8:
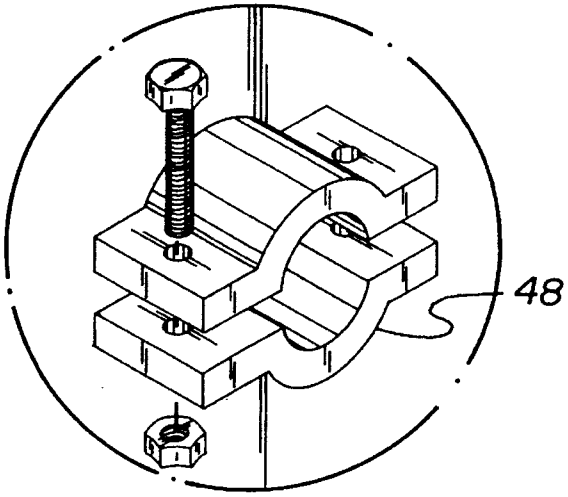
FIG. 8 is an enlarged perspective illustration taken about the circle 8 of FIG. 3.
Figure 9:
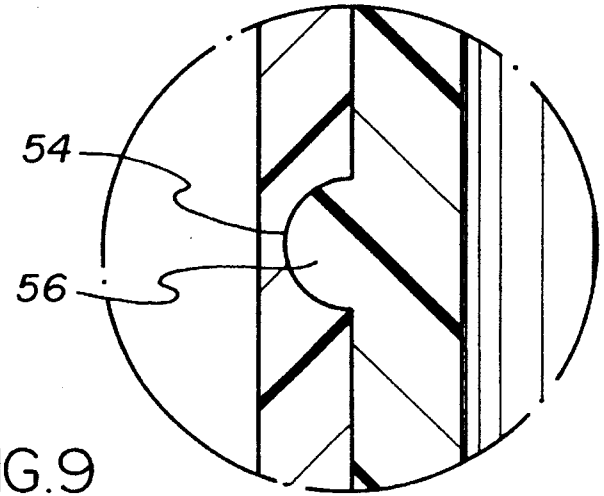
FIG. 9 is an enlarged cross sectional view taken alone circle 9 of FIG. 1.
Figure 7:
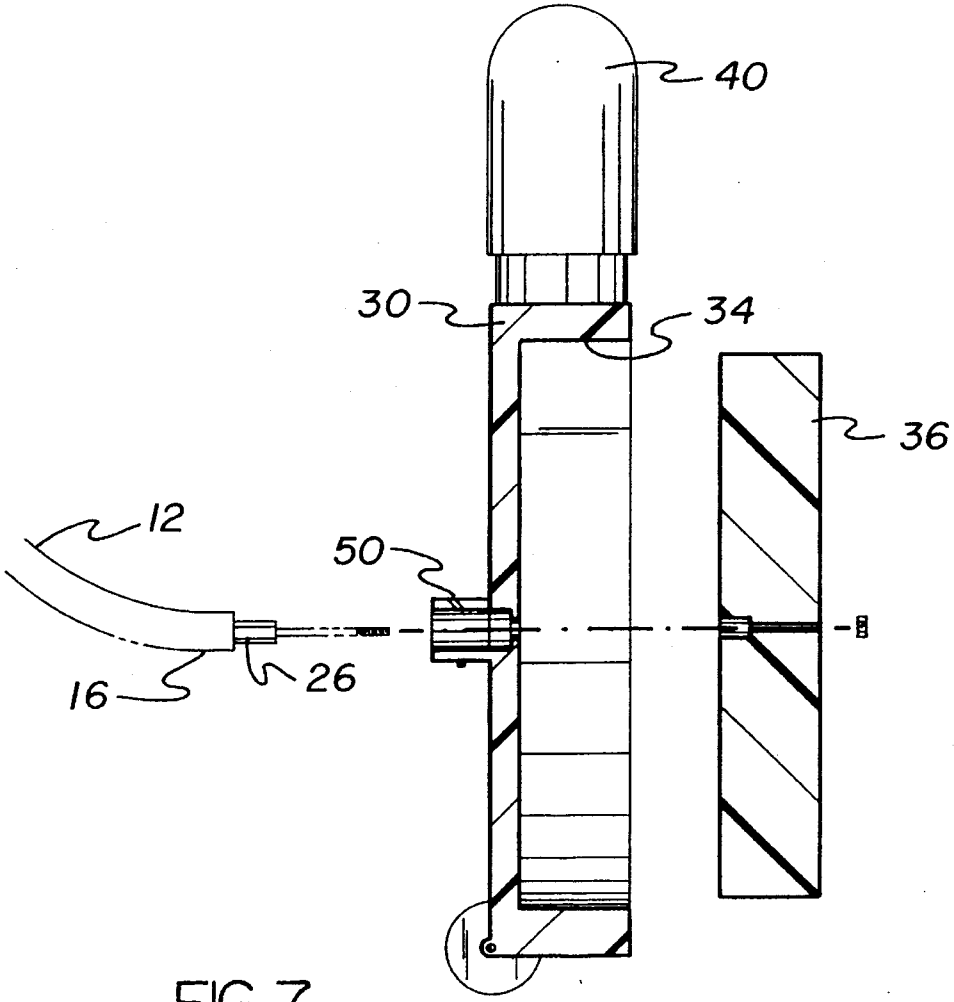

With reference now to the drawings, and in particular to FIG. 1 thereof, a new and improved small lightweight snow flinger embodying the principles and concepts of the present invention and generally designated by the reference numeral 10 will be described.

The present invention, the new and improved small lightweight snow flinger, is comprised of a plurality of components. Such components in their broadest context include a central post, a motor, motion imparting mechanisms, a box, blades, a pair of wheels and a releasable clamp. Such components are individually configured and correlated with respect to each other so as to attain the desired objective.

The present invention is a system 10 which has as its central component a central post 12. Such post is formed with a upper end 14, a lower end 16, and an intermediate extent 18 therebetween. The post is adapted to be held by a user. The post also has a bend of about 30 degrees adjacent to its lower end to allow the upper end to be held comfortably while the lower end assumes a horizontal orientation.

The next major component of the system 10 is a motor 22. Such motor is fixedly mounted on the upper end of the post. Its function is for providing power. The power may be done through a self-contained gas engine or it could be an electrical motor with a internal power source or an electrical cord to a source of potential.

Motion imparting mechanisms 26 extend along the length of the post interior thereof. Such mechanisms are in a nature of rotatable member extending from the motor to the lower end of the post where they are coupled to further components.

At the lower end of the post is a box 30. The box is of a generally rectangular configuration. It is secured with respect to the lower end of the post. The box has a central aperture 32 extending interiorly thereof is the nature of a recess. It extends all the way through the box but of a reduced diameter at its interior end. Such aperture 32 is circular with a horizontal axis.

Next provided are a plurality of blades 36. Such blades are rotatable about a horizontal axis which is coextensive with the axis of the aperture of the box. In addition, the axis of rotation of the blades is coextensive with the lower end of the power mechanisms 26 at the lower end of the tube. Such mechanisms 26 function to rotate the blades within the aperture. The function of the rotating blades is to move particulate matter such as snow which enters the aperture of the box between the rotating blades. The rotating blades then direct the snow upwardly to and through an arcuate tube 40 at the upper extent of the box. Such motion is for the passage of the particulate matter therethrough to a remote location away from the area being cleaned of snow.

Greater facility in moving the box and associated mechanisms is effected through a pair of wheels 44. Such wheels are mounted adjacent to the lower extent of the box. Ease of movement is thus facilitated during operation and use.

Coupling between the lower end of the post and the box is through a releasable clamp 48. Such clamp releasably couples the lower extent of the post which extends around a rearwardly projecting central extent 50 of the box.

The last feature of the present invention is the rotatability of the arcuate tube 40 with respect to the box 30. Such is effected through the provision of a recess 54 on the interior surface of the arcuate tube receiving an annular projection 56 extending radially outwardly from an upwardly extending projection of the box. In this manner, the particulate matter such as snow being cleaned may be directed to a desired location.

An attachment for a gasoline powered weed trimmer that enables its use as a snow blower. The invention is constructed from a small, lightweight impeller surrounded by a plastic housing. The fan is molded from aluminum or plastic with radially oriented blades, and measures eleven inches in diameter. It is attached to a drive shaft, which is in turn driven by the gasoline motor. The housing has a thin profile. It is just four inches wide. If has a twelve inch square front opening which feeds the snow to the impeller. The top of the housing is occupied by an outlet which can be adjusted to direct the flow of snow from the impeller. The base is fitted with two small wheels that make moving it over pavement much easier.

To use it, it must first be installed on the weed trimmer frame. As an option, it could be provided which its own dedicated motor. Once installed, the gasoline motor is started, which rotates the impeller. By moving it straight forward, snow is fed into the opening where it is forced out through the outlet port by the rotating impeller. The basic concept is the same as any ordinary snow blower, yet it is much lighter and easier to control. It is very lightweight and easy to use, and it can be stored in places where conventional snow blowers cannot. It is perfect for clearing walkways and steps, an impossible achievement for heavy snow blowers. Anyone who needs to clear snow from their property should appreciate its clear advantages.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A small lightweight snow flinger, comprising, in combination:

a central post with an upper end, a lower end and an intermediate extent therebetween adapted to be held by a user, the post having a bend of about 30 degrees adjacent to the lower end;

a motor fixedly mounted on the upper end of the post for providing power;

motion imparting mechanisms extending from the motor to the lower end of the post;

a box secured with respect to the lower end of the post, the box having a central aperture therethrough a horizontal orientation;

a plurality of blades rotatable about a horizontal axis coextensive with the aperture of the box with power mechanisms at the lower end of the tube to rotate the blades within the aperture and move snow entering the aperture between the rotating blades and to direct it upwardly through an arcuate tube at an upper extent of the box for passage of the snow therethrough, the upper extent having an annular projection disposed thereon for coupling with an annular recess within the arcuate tube to facilitate rotation thereof;

a pair of wheels mounted adjacent to a lower extent of the box to facilitate movement thereof; and a releasable clamp coupling the lower end of the post with a central extent of the box, the releasable clamp including a pair of generally U-shaped members having inner arcuate members removably coupling the lower end of the post to a cylindrical member on the box by a pair screws.

* * * * *